US008944181B2

(12) United States Patent
Sato

(10) Patent No.: US 8,944,181 B2
(45) Date of Patent: Feb. 3, 2015

(54) POWER TOOL WITH A TORQUE CLUTCH

(75) Inventor: Shinichiro Sato, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 255 days.

(21) Appl. No.: 12/675,766

(22) PCT Filed: Oct. 2, 2008

(86) PCT No.: PCT/JP2008/068323
§ 371 (c)(1),
(2), (4) Date: Feb. 26, 2010

(87) PCT Pub. No.: WO2009/044932
PCT Pub. Date: Apr. 9, 2009

(65) Prior Publication Data

US 2011/0048752 A1 Mar. 3, 2011

(30) Foreign Application Priority Data

| | | |
|---|---|---|
| Oct. 2, 2007 | (JP) | 2007-258241 |
| Mar. 10, 2008 | (JP) | 2008-059293 |
| Mar. 10, 2008 | (JP) | 2008-059294 |
| Mar. 10, 2008 | (JP) | 2008-059295 |
| Jun. 19, 2008 | (JP) | 2008-161034 |

(51) Int. Cl.
*B25B 23/147* (2006.01)
*B25B 23/14* (2006.01)

(52) U.S. Cl.
CPC ..... *B25B 23/141* (2013.01); *B25B 23/147* (2013.01)
USPC ..... 173/178; 173/176; 173/217; 173/164; 173/146

(58) Field of Classification Search
CPC .... B25B 1/00; B25B 23/0064; B25B 21/007; B25B 23/147; B25B 23/141; F16D 7/028; F16D 1/10; F16D 7/042
USPC ..... 173/176, 178, 217, 164, 146; 81/467, 81/473, 474, 475, 476; 192/70.11, 53.1, 192/3.22, 3.25, 3.26, 3.27
See application file for complete search history.

(56) References Cited

U.S. PATENT DOCUMENTS 3,389,727 A 6/1968 Feldpausch
3,585,817 A * 6/1971 McCafferty et al. ..... 464/47
(Continued)

FOREIGN PATENT DOCUMENTS

DE 10 2004 011 068 B3 6/2005
DE 20 2006 006 273 U1 6/2006
(Continued)

OTHER PUBLICATIONS

Russia Federal Service for Intellectual Property office action for application RU2010108418 (Sep. 14, 2011).
(Continued)

*Primary Examiner* — Michelle Lopez
(74) *Attorney, Agent, or Firm* — Kilpatrick Townsend & Stockton LLP

(57) ABSTRACT

A driving section generates rotational driving force and has an output shaft that outputs the rotational driving force. An end-bit mounting section holds an end bit and is rotatable about a rotational axis. A friction clutch is provided between the end-bit mounting section and the driving section. The friction clutch includes a drive member and a follow member. The drive member rotates together with the driving section and has a drive-side contact surface. The follow member rotates together with the end-bit mounting section and has a follow-side contact surface contactable with the drive-side contact surface. The friction clutch is movable between a transmission position where frictional force is produced between the drive-side contact surface and the follow-side contact surface so that the output shaft and the end-bit mounting section can rotate together, and a cutoff position where the output shaft and the end-bit mounting section are non-rotatable together.

30 Claims, 7 Drawing Sheets

(56) References Cited

U.S. PATENT DOCUMENTS

| | | | | |
|---|---|---|---|---|
| 4,655,103 | A | 4/1987 | Schreiber et al. | |
| 5,134,909 | A | 8/1992 | Sasaki | |
| 5,209,308 | A | 5/1993 | Sasaki | |
| 5,350,026 | A | 9/1994 | Markus et al. | |
| 5,662,011 | A | 9/1997 | Habermehl | |
| 5,735,183 | A | 4/1998 | Sasaki et al. | |
| 5,897,454 | A | 4/1999 | Cannaliato | |
| 6,669,072 | B2 | 12/2003 | Burke et al. | |
| 7,722,444 | B2 | 5/2010 | Gallagher et al. | |
| 8,087,976 | B2 | 1/2012 | Gallagher et al. | |
| 8,087,977 | B2 | 1/2012 | Gallagher et al. | |
| 2001/0025714 | A1* | 10/2001 | Lieser | 173/178 |
| 2002/0178877 | A1 | 12/2002 | Kikuchi et al. | |
| 2004/0245005 | A1* | 12/2004 | Toyama et al. | 173/48 |
| 2008/0142351 | A1 | 6/2008 | Gallagher et al. | |
| 2012/0077424 | A1 | 3/2012 | Gallagher et al. | |

FOREIGN PATENT DOCUMENTS

| | | | |
|---|---|---|---|
| EP | 0 724 934 | A1 | 8/1996 |
| GB | 1069852 | | 5/1967 |
| GB | 2 077 151 | A | 12/1981 |
| GB | 2146562 | A | 4/1985 |
| JP | 03-005952 | A | 1/1991 |
| JP | 05-104453 | A | 4/1993 |
| JP | 06-114749 | A | 4/1994 |
| JP | 04-129677 | A | 4/1995 |
| JP | 08-267367 | A | 10/1996 |
| JP | 09-323267 | A | 12/1997 |
| JP | 2000-502615 | A | 3/2000 |
| JP | 2003-025244 | A | 1/2003 |
| JP | 2004-122335 | A | 4/2004 |
| JP | 2004-535303 | A | 11/2004 |
| JP | 2006-315172 | A | 11/2006 |

OTHER PUBLICATIONS

Korean Intellectual Property Office (KIPO) office action for application KR10-2010-7005135 (Mar. 14, 2012).
Beitz, W. und Kuettner, K.-H., "Dubbel: Taschenbuch fuer den Maschinenbau," Springer, Berlin, p. G69-G70 (1987).
Russia Federal Service for Intellectual Property office action for application RU2010108418 (May 12, 2012).
Polytechnic Dictionary, Moscow, Soviet Encyclopedia, pp. 571-572 (1980).
Kraynev "Mechanics of Machines," Profound Dictionary, Moscow, Mechanical Engineering, pp. 795-796 (2000).
Japan Patent Office office action for application JP2008-059293 (May 9, 2013).
Japan Patent Office office action for application JP2008-059294 (May 9, 2013).
Japan Patent Office office action for application JP2008-059295 (May 9, 2013).
Japan Patent Office office action for application JP2008-059296 (May 9, 2013).
Japan Patent Office office action for application JP2008-059293 (Aug. 2, 2012).
Japan Patent Office office action for application JP2008-059294 (Aug. 2, 2012).
Japan Patent Office office action for application JP2008-059295 (Aug. 2, 2012).
Japan Patent Office office action for application JP2008-161034 (Sep. 24, 2012).
Office Action for Korean Intellectual Property Office patent application KR10-2010-7005135 (Sep. 26, 2012).

* cited by examiner

POWER TOOL WITH A TORQUE CLUTCH

CROSS-REFERENCE TO RELATED APPLICATIONS

This application is a National Stage of International Application No. PCT/JP2008/068323 filed Oct. 2, 2008, and which claims the benefit of Japanese Patent Application No. 2007-258241, filed Oct. 2, 2007, Japanese Patent Application No. 2008-059293, filed Mar. 10, 2008, Japanese Patent Application No. 2008-059294, filed Mar. 10, 2008, Japanese Patent Application No. 2008-059295, filed Mar. 10, 2008 and Japanese Patent Application No. 2008-161034, filed Jun. 19, 2008, the disclosures of which are incorporated herein by reference.

TECHNICAL FIELD

The present invention relates to a power tool.

BACKGROUND ART

Conventionally, a plate material such as a plaster board is fixed to a ceiling or to a wall by screw driving. A screw driver is a power tool for performing this screw driving. Japanese Examined Patent Application Publication No. H3-5952 discloses a screw driver including a motor and an end bit driven by the motor for driving a screw. The screw driver further includes a first clutch element, an intermediate clutch, and a second clutch element in this order between the motor and the end bit. With the screw driver, cam threads on the first clutch element located at the motor side engage motor-side cam threads on the intermediate clutch to rotate the intermediate clutch, and an engagement member of the intermediate clutch further rotates the second clutch element.

DISCLOSURE OF THE INVENTION

However, the clutches in the conventional screw driver engage each other in a full speed condition of the motor. Hence, even if driving force is transmitted in a staged manner with the intermediate clutch, a collision with a large speed difference occurs at some stage, which generates noise and worsens the operability. The cam threads are also worn down by the collision, which reduces the life of the screw driver.

In view of the foregoing, it is an object of the present invention to provide a power tool with low impact, low noise, and long life.

This and other object of the present invention will be attained by a power tool including a driving section, an end-bit mounting section, and a friction clutch. The driving section is configured to generate rotational driving force and has an output shaft that outputs the rotational driving force. The end-bit mounting section is configured to hold an end bit and to be rotatable about a rotational axis extending in an axial direction. The friction clutch is provided between the end-bit mounting section and the driving section. The friction clutch includes a drive member and a follow member. The drive member is configured to rotate together with the driving section and has a drive-side contact surface. The follow member is configured to rotate together with the end-bit mounting section and has a follow-side contact surface that is capable of contacting the drive-side contact surface. The friction clutch is movable between a transmission position where frictional force is produced between the drive-side contact surface and the follow-side contact surface so that the output shaft and the end-bit mounting section can rotate together, and a cutoff position where the output shaft and the end-bit mounting section are non-rotatable together.

With this arrangement, the rotational driving force of the driving section can be transmitted to the end-bit mounting section by the frictional force of the friction clutch. At this time, the rotational driving force is transmitted only by the frictional force between the drive-side contact surface of the drive member and the follow-side contact surface of the follow member. This suppresses the occurrence of an impact when the driving section and the end bit change from a non-transmission state to a transmission state. Accordingly, the power tool with low impact, low noise, and a long life can be provided.

Preferably, the driving section is configured to generate the rotational driving force selectively in a forward direction and in a reverse direction, and the power tool further includes a second clutch configured to transmit the rotational driving force of the output shaft only in the reverse direction to the end-bit mounting section via a different route from the friction clutch.

With this arrangement, the rotational driving force in the reverse direction for loosening a screw can be transmitted to the end-bit mounting section at least by the second clutch. Hence, the screw can be loosened without placing the friction clutch at the transmission position.

Preferably, the power tool further includes an accommodating section having an inner space and accommodating the drive member and the follow member in the inner space, and a seal member that isolates the inner space of the accommodating section from outside of the accommodating section.

With this arrangement, the friction clutch can be hermetically sealed within the accommodating section. Thus, oil and the like from outside of the accommodating section is prevented from adhering to the friction clutch, and the coefficient of friction of the friction clutch can be stabilized.

Preferably, the driving section is configured to generate the rotational driving force selectively in a forward direction and in a reverse direction. The friction clutch serves as a first clutch. The power tool further includes a second clutch provided between the end-bit mounting section and the driving section. When the first clutch is at the transmission position, the rotational driving force of the driving section at least in the forward direction can be transmitted to the end-bit mounting section. When the first clutch is at the cutoff position, the rotational driving force of the driving section is cut off before the end-bit mounting section. The second clutch is configured to transmit the rotational driving force of the driving section only in the reverse direction to the end-bit mounting section via a different route from the first clutch.

With this arrangement, the rotational driving force in the reverse direction for loosening a screw can be transmitted to the end-bit mounting section at least by the second clutch. Hence, the screw can be loosened without placing the first clutch at the transmission position.

Preferably, the first clutch is configured to transmit the rotational driving force of the driving section both in the forward direction and in the reverse direction to the end-bit mounting section when the first clutch is at the transmission position.

With this arrangement, a screw can be rotated in the reverse direction via two transmission routes of the first clutch and the second clutch when the first clutch is at the transmission position.

Preferably, the first clutch includes a multiple-plate friction clutch.

With this arrangement, the rotational driving force of the driving section can be transmitted to the end bit only by the frictional force of the multiple-plate friction clutch. At this time, the rotational driving force is transmitted only by the friction force between plates, which suppresses the occurrence of an impact when the driving section and the end bit change from a non-transmission state to a transmission state.

Preferably, the multiple-plate friction clutch includes a plurality of drive members and a plurality of follow members. The plurality of drive members rotates together with the driving section, each of the plurality of drive members having a plate shape. The plurality of follow members rotates together with the end-bit mounting section, each of the plurality of follow members having a plate shape. The plurality of drive members and the plurality of follow members are arranged alternately from the end-bit mounting section side toward the driving section side. One of the plurality of follow members is the closest to the end-bit mounting section.

With this arrangement, the end-bit mounting section or a member that rotates with the end-bit mounting section contacts the follow member positioned closest to the end-bit mounting section, and a member that rotates with the output shaft of the driving section contacts the drive member positioned closest to the driving section. Thus, the follow member positioned closest to the end-bit mounting section receives frictional force only from the adjacent drive member, which suppresses the occurrence of friction between the follow member positioned closest to the end-bit mounting section and a member at the end-bit mounting section side. Similarly, the drive member positioned closest to the driving section receives frictional force only from the adjacent follow member, which suppresses the occurrence of friction between the drive member positioned closest to the driving section and a member at the driving section side.

Preferably, the power tool further includes a gear mechanism rotatably driven by the output shaft to decelerate rotation of the output shaft, and a shaft connected to the end-bit mounting section and configured to rotate coaxially with the end bit. The multiple-plate friction clutch is arranged between the gear mechanism and the shaft.

With this arrangement, the shaft, the end bit, and the gear mechanism can be arranged coaxially, and a compact power tool can be provided.

Preferably, the end-bit mounting section is fitted to the shaft.

With this arrangement, the length of the power tool in the direction from the end-bit mounting section toward the driving section can be shortened.

Preferably, the rotational driving force of the driving section in the forward direction is transmitted to the end-bit mounting section only via the multiple-plate friction clutch. The transmission efficiency of the rotational driving force in the forward direction changes in response to movement of the multiple-plate friction clutch in the axial direction.

With this arrangement, the transmission efficiency of the multiple-plate friction clutch can be changed to adjust the degree of operation of the clutch (the degree of slippage), by changing the pressing force of the power tool against a workpiece. Thus, preferable rotations can be maintained depending on the hardness of driving a screw.

Preferably, the multiple-plate friction clutch is arranged coaxially with the rotational axis of the end-bit mounting section. With this arrangement, the power tool can be made even more compact.

Preferably, the power tool further includes a plurality of springs arranged adjacent to the multiple-plate friction clutch at either one of the end bit side and the driving section side or at both of the end bit side and the driving section side. The plurality of springs is configured to urge the multiple-plate friction clutch toward at least one of the end bit side and the driving section side. At least one of the plurality of springs is prevented from being compressed by an amount greater than a predetermined amount, allowing the plurality of springs to have a combined spring constant that changes at the predetermined amount.

With this arrangement, when the power tool is pressed against a workpiece, the relationship between the pressing force of the power tool against the workpiece and the degree of operation of the multiple-plate friction clutch can be changed. More specifically, since the power tool is pressed against the workpiece until the spring is compressed by the predetermined amount, the spring constant is set to a smaller value so that the multiple-plate friction clutch operates readily. Then, after the spring is compressed by the predetermined amount, the spring constant is set to a larger value so that the multiple-plate friction clutch does not lock easily. If the springs are at the end bit side, the springs urge the multiple-plate friction clutch toward the driving section side. If the springs are at the driving section side, the springs urge the multiple-plate friction clutch toward the end bit side. If the springs are at the both sides, the springs urge the multiple-plate friction clutch toward the respective opposite sides.

Preferably, the plurality of springs is arranged in series adjacent to the multiple-plate friction clutch at either one of the end bit side and the driving section side or at both of the end bit side and the driving section side. Alternatively, the plurality of springs may be arranged in parallel adjacent to the multiple-plate friction clutch at either one of the end bit side and the driving section side.

With this arrangement, if the springs are arranged in series, the widths in directions perpendicular to the rotational axis direction of the power tool can be made smaller. If the springs are arranged in parallel, the length in the rotational axis direction of the power tool can be made smaller.

Preferably, the friction clutch includes a multiple-plate friction clutch configured to be movable in the axial direction. The multiple-plate friction clutch is configured to move in the axial direction to transmit the rotational driving force of the output shaft to the end bit in a state where the end bit is pressed against a workpiece.

With this arrangement, the rotational driving force of the driving section can be transmitted to the end bit only by the frictional force of the multiple-plate friction clutch. At this time, the rotational driving force is transmitted only by the friction force between plates, which suppresses the occurrence of an impact when the driving section and the end bit change from a non-transmission state to a transmission state.

Preferably, the end-bit mounting section is configured to be movable in the axial direction between a first position and a second position. The drive member has a first engaging section serving as the drive-side contact surface. The follow member has a second engaging section capable of engaging the first engaging section and serving as the follow-side contact surface. The first engaging section and the second engaging section are configured to be in non-engagement with each other when the end-bit mounting section is at the first position and to be in engagement with each other when the end-bit mounting section is at the second position. One of the first engaging section and the second engaging section has a conical convex section, and another one of the first engaging section and the second engaging section has a conical concave section.

With this arrangement, the rotating first engaging section and the second engaging section to which the rotational driving force is transmitted from the first engaging section are configured by the conical convex section and the conical concave section. Hence, the transmission efficiency of rotation can be improved, while suppressing noises due to the transmission of the rotation between the first engaging section and the second engaging section.

According to another aspect, the present invention also provides a power tool including a driving section, an end-bit mounting section, a first clutch, and a second clutch. The driving section is configured to generate rotational driving force selectively in a forward direction and in a reverse direction. The driving section has an output shaft that outputs the rotational driving force. The end-bit mounting section is configured to hold an end bit and to be rotatable about a rotational axis. The first clutch and the second clutch are both provided between the end-bit mounting section and the driving section. The first clutch is movable between a transmission position where the rotational driving force of the driving section at least in the forward direction can be transmitted to the end-bit mounting section, and a cutoff position where the rotational driving force of the driving section is cut off before the end-bit mounting section. The second clutch is configured to transmit the rotational driving force of the driving section only in the reverse direction to the end-bit mounting section via a different route from the first clutch.

With this arrangement, the rotational driving force in the reverse direction for loosening a screw can be transmitted to the end-bit mounting section at least by the second clutch. Hence, the screw can be loosened without placing the first clutch at the transmission position.

According to still another aspect, the present invention also provides a power tool including a driving section, an end-bit mounting section, and a multiple-plate friction clutch. The driving section is configured to generate rotational driving force and has an output shaft that outputs the rotational driving force. The end-bit mounting section is configured to hold an end bit and to be rotatable about a rotational axis extending in an axial direction. The multiple-plate friction clutch is provided between the end-bit mounting section and the driving section. The multiple-plate friction clutch is configured to be movable in the axial direction and is configured to move in the axial direction to transmit the rotational driving force of the output shaft to the end bit in a state where the end bit is pressed against a workpiece.

With this arrangement, the rotational driving force of the driving section can be transmitted to the end bit only by the frictional force of the multiple-plate friction clutch. At this time, the rotational driving force is transmitted only by the friction force between plates, which suppresses the occurrence of an impact when the driving section and the end bit change from a non-transmission state to a transmission state.

According to still another aspect, the present invention also provides a power tool including a driving section, an end-bit mounting section, a drive member, and a follow member. The driving section is configured to generate rotational driving force. The end-bit mounting section is configured to hold an end bit and to be rotatable about a rotational axis extending in an axial direction. The end-bit mounting section is configured to be movable in the axial direction between a first position and a second position. The drive member receives the rotational driving force of the driving section and is rotatable by the rotational driving force. The drive member has a first engaging section. The follow member has a second engaging section capable of engaging the first engaging section. The follow member is rotatable. The first engaging section and the second engaging section are configured to be in non-engagement with each other when the end-bit mounting section is at the first position and to be in engagement with each other when the end-bit mounting section is at the second position. One of the first engaging section and the second engaging section has a conical convex section, and another one of the first engaging section and the second engaging section has a conical concave section.

With this arrangement, the rotating first engaging section and the second engaging section to which the rotational driving force is transmitted from the first engaging section are configured by the conical convex section and the conical concave section. Hence, the transmission efficiency of rotation can be improved, while suppressing noises due to the transmission of the rotation between the first engaging section and the second engaging section.

BRIEF DESCRIPTION OF REFERENCE NUMERALS

1, 101, 201: Screw driver
2, 102, 202: Housing
3, 203: Motor
4, 104, 204: Clutch Section
5, 205: End-Bit Mounting Section
10, 110, 210: Bit
21: Handle
21A, 221A: Trigger
21B, 221B: Power Code
21C: Circuit Section
21D: Switch
31, 131, 231: Rotational Shaft
31A, 131A: Bearing
32, 132, 232: Pinion
33, 133: Fan
41, 141: Clutch Drum
41A, 141A, 241A: Gear
41B: Convex Sections
41C, 141C: Wall Section
41D, 141E: Accommodating Section
41*a:* Hole
42, 142, 242: Spline Shaft
42A: Convex Sections
43*a:* Concave Sections
43*b:* Opening
43, 143: First Clutch Plates

44, 144: Second Clutch Plates
44*a:* Concave Sections
44*b:* Opening
45, 145: One-way Clutch
46, 146: Spring
47A, 147A: Bearing
47B: Bearing
48: First Seal Member
51, 151: Socket
51A: Contact Section
51*a:* Mounting Hole
52, 152, 252: Bearing
53: Second Seal Member
54, 154, 254: Cover
141D: First Spring
151A: Second Spring
241: Drive Member
243: Conical Section
243S: Convex Section
244: Follow Member
244S: Concave Section
251: Balls

BEST MODE FOR CARRYING OUT THE INVENTION

<First Embodiment>

Figure 1:
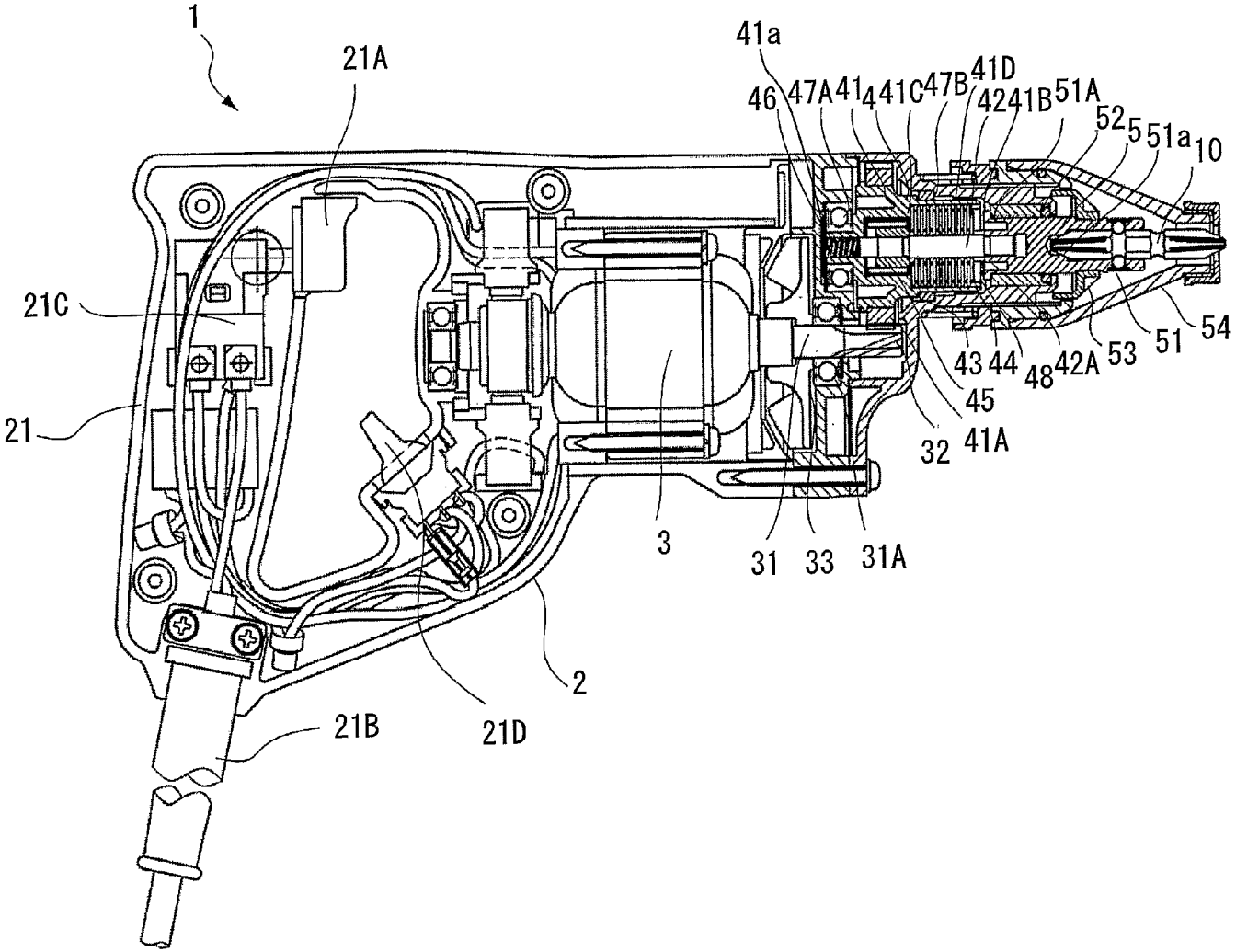
FIG. 1 is a cross-sectional view showing a screw driver embodying a power tool according to a first embodiment of the present invention.

A power tool according to a first embodiment of the present invention will be described while referring to FIGS. 1 through 6. The power tool of the present embodiment is applied to a screw driver. As shown in FIG. 1, a screw driver 1 mainly includes a housing 2, a motor 3, a clutch section 4, and an end-bit mounting section 5. A bit 10 serving as an end bit is mounted on the end-bit mounting section 5. The side on which the bit 10 is mounted is defined as the front side of the screw driver 1, and the side of a handle 21 to be described later is defined as the rear side of the screw driver 1.

The housing 2 constitutes an outer shell of the screw driver 1, and includes the handle 21 serving as a handle section at its rear end. The handle 21 is provided with a trigger 21A for performing drive control of the motor 3 and a switch 21D for performing control of the rotation direction (forward and reverse) of the motor 3. The handle 21 is also provided with a power code 21B that is connected to an outer power source (not shown). A circuit section 21C is provided within the handle 21 for electrically connecting the power code 21B to the motor 3 via the trigger 21A.

The motor 3 is disposed within the housing 2 at the front side of the handle 21. The motor 3 has a rotational shaft 31 serving as an output shaft and rotatable about a rotational axis extending in the front-rear direction. The rotational shaft 31 is supported by the housing 2 via a bearing 31A, and has a pinion 32 at its distal end (front end). A fan 33 is fixed to the proximal end (rear end) of the rotational shaft 31 so as to rotate coaxially with the rotational shaft 31. For the rotational shaft 31 and the parts rotatably driven by the rotational shaft 31, the rotation for driving a screw in is defined as the forward rotation, whereas the rotation for loosening a screw is defined as the reverse rotation.

Figure 2:
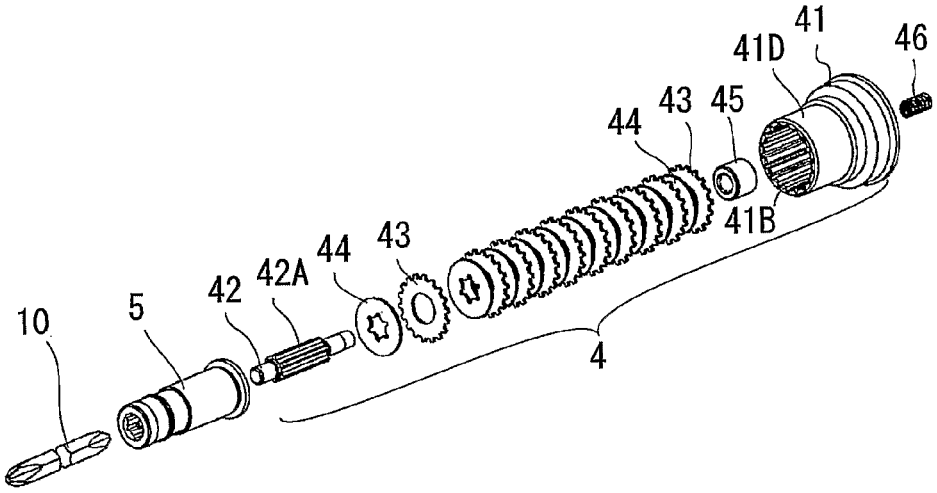
FIG. 2 is an exploded perspective view showing a clutch drum of the screw driver according to the first embodiment.
Figure 3:
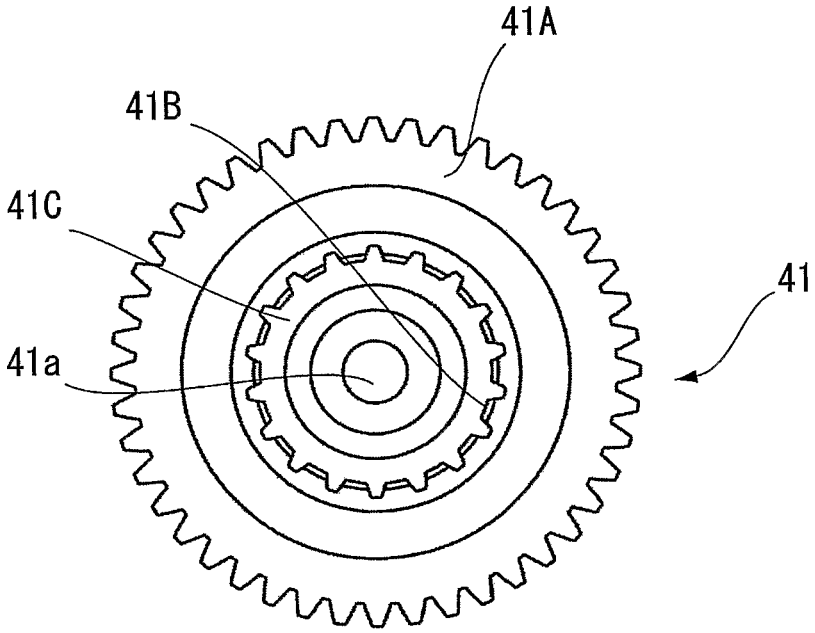
FIG. 3 is a front view showing the clutch drum of the screw driver according to the first embodiment.

As shown in FIG. 2, the clutch section 4 mainly includes a clutch drum 41, a spline shaft 42, ten first clutch plates 43 serving as drive members, ten second clutch plates 44 serving as follow members, and a one-way clutch 45. The clutch drum 41 includes, at its front side, an accommodating section 41D having substantially a hollow cylindrical shape and formed with a space that accommodates the first clutch plates 43 and the second clutch plates 44. The clutch drum 41 is supported by the housing 2 via a bearing 47A serving as a first bearing and a bearing 47B (FIG. 1), so as to be rotatable about the axis of the hollow cylindrical accommodating section 41D. As shown in FIGS. 1 and 3, a gear 41A is provided at the outer circumference of a portion of the clutch drum 41 located at the rear end of the accommodating section 41D. The gear 41A meshingly engages the pinion 32. As shown in FIGS. 2 and 3, a plurality of convex sections 41B each extending in the axial direction is arranged on the inner surface of the accommodating section 41D at regular intervals in the circumferential direction. As shown in FIG. 1, a wall section 41C is provided at the rear end of the convex sections 41B within the accommodating section 41D. The one-way clutch 45 is mounted on the wall section 41C. As shown in FIG. 3, a hole 41*a* is formed at a portion of the clutch drum 41 at the rear side of the one-way clutch 45, the portion being supported by the bearing 47A. A spring 46 (FIGS. 1 and 2) is disposed within the hole 41*a*.

Figure 4:
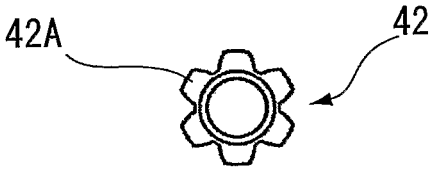
FIG. 4 is a cross-sectional view showing a spline shaft of the screw driver according to the first embodiment.

As shown in FIG. 1, the spline shaft 42 is fixed to the end-bit mounting section 5 so as to be rotatable coaxially with the end-bit mounting section 5. The spline shaft 42 is supported by the one-way clutch 45 within the hollow cylindrical part of the clutch drum 41. The rear end of the spline shaft 42 contacts the spring 46 so that the spline shaft 42 is urged forward by the spring 46. As shown in FIGS. 2 and 4, a plurality of convex sections 42A each extending in the axial direction is arranged on the surface of the spline shaft 42 at a portion exposed within the clutch drum 41, the spline shaft 42 being arranged at regular intervals in the circumferential direction.

Figure 5:
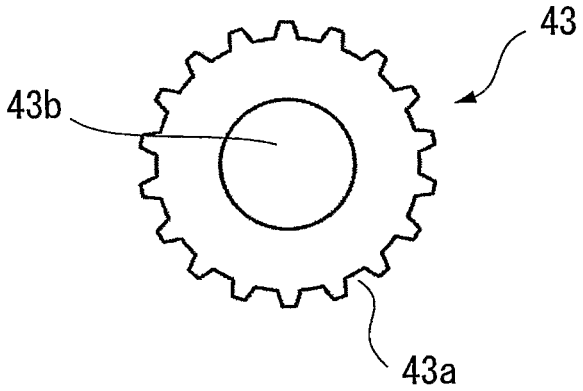
FIG. 5 is a front view showing a first clutch plate of the screw driver according to the first embodiment.

As shown in FIG. 5, a plurality of concave sections 43*a* is formed along the outer circumference of each of the first clutch plates 43 for meshingly engaging the convex sections 41B of the clutch drum 41. An opening 43*b* through which the spline shaft 42 extends is formed in the inner part of each of the first clutch plates 43. As shown in FIG. 2, each of the first clutch plates 43 has a plate-like shape having a drive-side contact surface that contacts the second clutch plate 44. As shown in FIG. 1, in a state where the first clutch plates 43 are aligned and mounted within the clutch drum 41 so that the concave sections 43*a* are in meshing engagement with the convex sections 41B, the first clutch plates 43 are allowed to move in the axial direction relative to the clutch drum 41, but are prohibited from rotating in the circumferential direction relative to the clutch drum 41. Among the ten first clutch plates 43, the first clutch plates 43 at the rearmost position can contact the wall section 41C.

Figure 6:
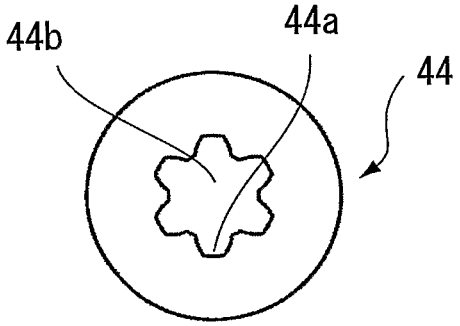
FIG. 6 is a front view showing a second clutch plate of the screw driver according to the first embodiment.

As shown in FIG. 6, each of the second clutch plates 44 has a circular disk shape having such a diameter that the second clutch plate 44 does not interfere with the convex sections 41B. Each of the second clutch plates 44 has a follow-side contact surface that contacts the first clutch plate 43. An opening 44*b* through which the spline shaft 42 extends is formed in the center part of each of the second clutch plates 44, the opening 44*b* having a plurality of concave sections 44*a* that meshingly engages the convex sections 42A. In a state where the second clutch plates 44 are mounted on the spline shaft 42 so that the concave sections 44*a* are in meshing engagement with the convex sections 42A, the second clutch plates 44 are allowed to move in the axial direction relative to the spline shaft 42, but are prohibited from rotating in the circumferential direction relative to the spline shaft 42. Among the ten second clutch plates 44, the second clutch plate 44 at the foremost position can contact a contact section 51A to be described later, which is the rear end section of the end-bit mounting section 5.

The first clutch plates 43 and the second clutch plates 44 are arranged alternately from the position of the wall section 41C toward the front side, thereby constituting a first clutch. As described above, each of the first clutch plates 43 and the second clutch plates 44 is allowed to move in the axial direction. Hence, when the second clutch plate 44 at the foremost position contacts the rear end section of the end-bit mounting section 5 and is urged rearward, the first clutch plates 43 and the second clutch plates 44 move rearward (transmission position), and friction is generated between the adjacent ones of the drive-side contact surface of the first clutch plate 43 and the follow-side contact surface of the second clutch plate 44. Due to the friction generated in this way, the clutch drum 41 and the spline shaft 42 rotates together (corotates) coaxially via the first clutch plates 43 and the second clutch plates 44. In contrast, in a state where the second clutch plate 44 at the foremost position is not urged rearward (cutoff position), no or little friction is generated between the adjacent ones of the first clutch plate 43 and the second clutch plate 44. Hence, the corotation of the clutch drum 41 and the spline shaft 42 via the first clutch plates 43 and the second clutch plates 44 is suppressed. With this arrangement, driving force is transmitted by the frictional force between the ten first clutch plates 43 and the ten second clutch plates 44, thereby reducing a stress such as frictional force applied to one of the first and second clutch plates 43 and 44, which increases the life of the clutch section 4. Note that the first clutch plate 43 at the rearmost position contacts the wall section 41C that rotates together with the first clutch plates 43, and that the second clutch plate 44 at the foremost position contacts the contact section 51A that rotates together with the second clutch plates 44. Thus, no friction is generated between the first clutch plate 43 at the rearmost position and the wall section 41C, and no friction is generated between the second clutch plate 44 at the foremost position and the end-bit mounting section 5. This improves the durability of the clutch drum 41 having the wall section 41C and the durability of the end-bit mounting section 5.

The spline shaft 42 is supported indirectly by the bearing 47A (first bearing) and a bearing 52 (second bearing) to be described later, so that the first clutch plates 43 and the second clutch plates 44 are located between the bearing 47A and the bearing 52. Hence, even if a load or stress is added to the spline shaft 42 when friction is generated, the occurrence of chatter and wobble is suppressed since the both ends of the spline shaft 42 are supported.

The one-way clutch 45 is mounted on the wall section 41C and supports the rear end of the spline shaft 42. When the clutch drum 41 rotates in the reverse direction, the one-way clutch 45 transmits driving force to the spline shaft 42 by a different route from the first clutch plates 43 and the second clutch plates 44. In contrast, when the clutch drum 41 rotates in the forward direction, the one-way clutch 45 is not capable of transmitting driving force to the spline shaft 42. The first clutch plates 43 and the second clutch plates 44 cannot transmit driving force in the forward or reverse direction from the clutch drum 41 to the spline shaft 42 unless frictional force is generated. However, because the one-way clutch 45 always transmits driving force from the clutch drum 41 to the spline shaft 42 when the clutch drum 41 rotates in the reverse direction, the end-bit mounting section 5 can be rotated in the reverse direction even when no friction occurs between the first clutch plates 43 and the second clutch plates 44.

Comparing the diameters (perpendicular to the rotational axis) of the clutch drum 41 and the end-bit mounting section 5, the diameter of the clutch drum 41 is larger than the diameter of the end-bit mounting section 5, the clutch drum 41 being at the drive side for transmitting driving force to the spline shaft 42. Hence, the housing 2 can be configured to have a small diameter at the end-bit mounting section 5 side, thereby enabling screw driving operations at narrow places. In addition, the inertia mass of the clutch drum 41 that rotates together with the first clutch plates 43 can be made large. Thus, when frictional force is generated between the first clutch plates 43 and the second clutch plates 44 in the transmission position, a drop in rotation speeds of the clutch drum 41 and the motor 3 connected to the clutch drum 41 can be suppressed.

As shown in FIG. 1, a first seal member 48 is provided in the opening part of the accommodating section 41D accommodating the first clutch plates 43 and the second clutch plates 44. The first seal member 48 fills the gap between the accommodating section 41D and a socket 51 to be described later, to maintain the inner part of the accommodating section 41D in a sealed state (i.e., to isolate the inner part of the accommodating section 41D from outside of the accommodating section 41D). Because the socket 51 is rotatably supported by the bearing 52 to be described later, grease is filled around the socket 51 for reducing rotation resistance. If the grease enters the accommodating section 41D and adheres to the first clutch plates 43 and the second clutch plates 44, the coefficient of friction changes so that driving force cannot be transmitted efficiently from the clutch drum 41 to the spline shaft 42 via the first clutch plates 43 and the second clutch plates 44. Thus, by providing the first seal member 48 to prevent the grease from entering the accommodating section 41D, a change in the coefficient of friction between the first clutch plates 43 and the second clutch plates 44 can be prevented, and stable screw driving operations can be performed.

The end-bit mounting section 5 mainly includes the socket 51. The front end of the socket 51 is formed with a mounting hole 51*a* into which the bit 10 is mounted, while the rear end of the socket 51 is fitted to and connected with the spline shaft 42. The socket 51 is supported by the bearing 52 (second bearing) provided to the housing 2, so that the socket 51 can rotate in the circumferential direction and can move in the axial direction. Because the socket 51 is fitted to and mounted on the spline shaft 42, the overall length of the end-bit mounting section 5 and the spline shaft 42 can be shortened, thereby reducing the overall length of the screw driver 1.

The contact section 51A is provided at the rear end of the socket 51 (i.e., at a position adjacent to the connection section between the socket 51 and the spline shaft 42), the contact section 51A being capable of contacting the second clutch plate 44 at the foremost position. The rearward movement of the end-bit mounting section 5 causes the contact section 51A to contact the second clutch plate 44 at the foremost position, thereby pressing the second clutch plates 44 against the first clutch plates 43.

A second seal member 53 is provided to the socket 51 at the front side of the bearing 52 for preventing the grease filled around the socket 51 from flowing outward. A cover 54 is provided around the socket 51 and the second seal member 53. The cover 54 can be easily detached, and is configured so that the tip of the bit 10 is slightly exposed through its front end section.

When the bit 10 mounted on the front end of the end-bit mounting section 5 contacts a screw (not shown) and is pressed rearward by the reaction force from the screw, the end-bit mounting section 5 moves rearward and friction occurs between the first clutch plates 43 and the second clutch plates 44. However, in a state where the screw (not shown) is driven and buried in a workpiece (not shown), there is no need to drive the screw any farther. Thus, in this state, the front end section of the cover 54 contacts the workpiece (not shown) to cancel the reaction force acting on the bit 10 from the screw, thereby reducing the friction between the first clutch plates 43 and the second clutch plates 44 to cut off the transmission of the driving force to the bit 10.

When the above-described screw driver 1 is used to drive a screw, a user aligns the bit 10 with the head of a screw (not shown) and presses the bit 10 against the screw. Due to the reaction force acting on the bit 10 from the screw, the socket 51 moves toward the clutch drum 41 side, the contact section 51A contacts the second clutch plate 44 at the foremost position, and the friction occurs between the first clutch plates 43 and the second clutch plates 44. In this way, the clutch drum 41 and the spline shaft 42 can rotate together to transmit the output from the motor 3 in the forward direction to the socket 51 and the bit 10. At this time, the frictional force between the first clutch plates 43 and the second clutch plates 44 increases gradually, which substantially suppresses the impact that occurs when the clutch drum 41 and the spline shaft 42 start rotating together and thereby reduces noises. In addition, because the frictional force is changed in response to the pressing force of the bit 10 against the screw, the user can easily control the rotation of the bit 10 by adjusting the pressing force.

When the bit 10 is separated from the screw after screw driving is done, the urging force of the spring 46 causes the spline shaft 42 and the socket 51 to move forward. This movement puts to an end the contact between the contact section 51A and the second clutch plate 44 at the foremost position, which reduces the friction between the first clutch plates 43 and the second clutch plates 44, thereby suppressing the transmission of the output from the motor 3 to the socket 51.

In order to pull out a screw (not shown) from a workpiece (not shown) when the screw is driven into a wrong position, the user turns the switch 21D to the reverse side to rotate the motor 3 in the reverse direction. If the head of the screw protrudes from the workpiece at this time, the reaction force acting on the bit 10 from the screw causes the friction between the first clutch plates 43 and the second clutch plates 44 to occur. Thus, the driving force in the reverse direction is transmitted to the bit 10, allowing the screw to be pulled out efficiently. However, if the head of the screw does not protrude from the workpiece (i.e., if the screw is buried in the workpiece), the cover 54 prevents the bit 10 from contacting the screw with sufficient force. Even if the bit 10 contacts the screw, the bit 10 cannot receive sufficient reaction force from the screw, and sufficient frictional force may not be generated between the first clutch plates 43 and the second clutch plates 44. In this case, the driving force cannot be transmitted from the clutch drum 41 to the spline shaft 42 via the first clutch plates 43 and the second clutch plates 44. However, because the driving force is in the reverse direction, the driving force can be transmitted from the clutch drum 41 to the spline shaft 42 via the one-way clutch 45. Accordingly, the screw can be pulled out efficiently even when the bit 10 cannot receive the reaction force from the screw during the reverse rotation of the motor 3.

<Second Embodiment>

Figure 7:
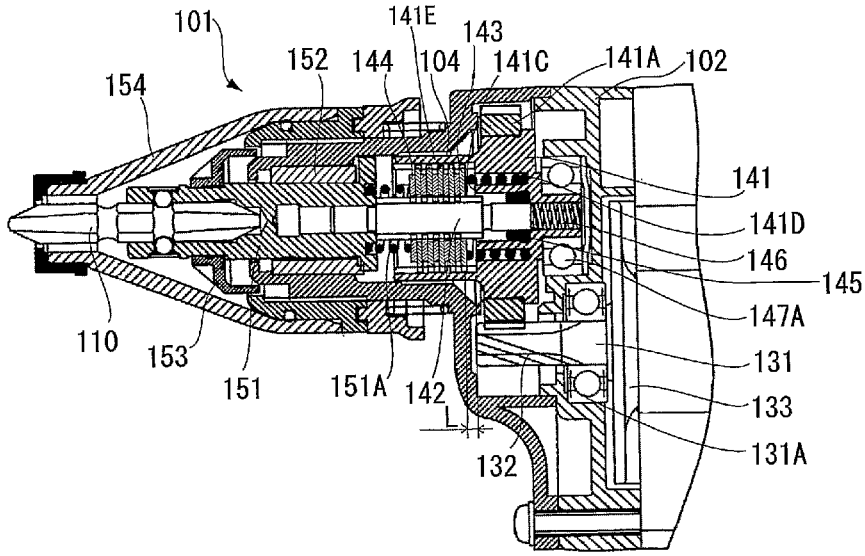
FIG. 7 is a cross-sectional view showing the relevant parts of a screw driver embodying a power tool according to a second embodiment of the present invention.

A power tool according to a second embodiment of the present invention will be described while referring to FIG. 7. The power tool of the present embodiment is applied to a screw driver. A screw driver 101 shown in FIG. 7 has basic structure which is the same as the structure of the screw driver 1 according to the first embodiment.

A rotational shaft 131 of a motor (not shown) is supported by a housing 102 via a bearing 131A, and has a pinion 132 at its distal end (front end). A fan 133 is fixed to the proximal end (rear end) of the rotational shaft 131. A clutch section 104 mainly includes a clutch drum 141, a spline shaft 142, first clutch plates 143 serving as drive members, second clutch plates 144 serving as follow members, and a one-way clutch 145. A gear 141A is provided at the outer circumference of a portion of the clutch drum 141 so as to meshingly engage the pinion 132. The clutch drum 141 includes an accommodating section 141E formed with a space that accommodates the first clutch plates 143 and the second clutch plates 144. The clutch drum 141 is rotatably supported by the housing 102 via a bearing 147A. The rear end of the spline shaft 142 contacts a spring 146 so that the spline shaft 142 is urged forward by the spring 146. A socket 151 is supported by a bearing 152 so as to be rotatable in the circumferential direction and to be movable in the axial direction. A seal member 153 is provided to the socket 151 at the front side of the bearing 152. A cover 154 is provided around the socket 151 and the seal member 153.

A wall section 141C of the clutch drum 141 is formed with a groove in which a first spring 141D (spring constant: $k_1$) is disposed. The front end of the first spring 141D protrudes from a surface of the clutch drum 141, the surface being in confrontation with the first clutch plate 143 at the rearmost position. Thus, the front end of the first spring 141D is capable of contacting the first clutch plate 143 at the rearmost position.

A second spring 151A (spring constant: $k_2$) is disposed between the socket 151 and the second clutch plate 144 at the foremost position. With this arrangement, the rearward movement of the socket 151 causes the second spring 151A to urge rearward the second clutch plate 144 at the foremost position.

During a screw driving operation with the screw driver 101, when a bit 110 is pressed against a screw (not shown), the first clutch plates 143 and the second clutch plates 144 are sandwiched between the first spring 141D and the second spring 151A. At this time, the frictional force between the first clutch plates 143 and the second clutch plates 144 increases with the combined spring constant ($k_1 \cdot k_2/(k_1+k_2)$) of the first spring 141D and the second spring 151A as the proportionality coefficient, until the first clutch plates 143 move rearward by a distance L. After the first clutch plates 143 move rearward by the distance L, the first clutch plate 143 at the rearmost position contacts the wall section 141C, which cancels the effects of the urging force of the first spring 141D. From this point on, the frictional force between the first clutch plates 143 and the second clutch plates 144 increases with the spring constant $k_2$ of the second spring 151A as the proportionality coefficient. Here, the spring constant $k_2$ of the second spring 151A is larger than the combined spring constant ($k_1 \cdot k_2/(k_1+k_2)$) of the first spring 141D and the second spring 151A. Accordingly, since the screw driver 101 (more specifically, the bit 110) is pressed against the screw (not shown) until the first clutch plates 143 move rearward by the predetermined distance L (i.e., until the first spring 141D is compressed by the predetermined compression amount L), the spring constant for the first clutch plates 143 and the second clutch plates 144 is set to a smaller value so that the clutch section 104 operates readily. Then, after the first clutch plates 143 move rearward by the predetermined distance L (i.e., after the first spring 141D is compressed by the predetermined compression amount L), the spring constant for the first clutch plates 143 and the second clutch plates 144 is set to a larger value so that the clutch section 104 does not lock easily (i.e., the first clutch plates 143 and the second clutch plates 144 do not slip easily).

In the above-described second embodiment, the first spring and the second spring are arranged in series. However, a first spring (spring constant $k_1$) and a second spring (spring constant $k_2$) may be arranged in parallel. In this modification, a first clutch plate at the rearmost position is in contact with a wall section of a clutch drum. Until a socket moves by a predetermined distance, only the first spring contacts and urges a second clutch plate at the foremost position. After the socket moves by the predetermined distance, both the first spring and the second spring contact and urge the second clutch plate at the foremost position. With this arrangement, until the socket moves by the predetermined distance, the frictional force between the clutch plates increases with the spring constant $k_1$ as the proportionality coefficient. After the socket moves by the predetermined distance, the frictional force between the clutch plates increases with the spring constant $k_1+k_2$ as the proportionality coefficient. Thus, the effects similar to those of the second embodiment can be obtained.

When the first spring and the second spring are arranged in series as in the second embodiment, the widths in directions perpendicular to the rotational axis direction of the screw driver can be made smaller. In contrast, when the first spring and the second spring are arranged in parallel, the length in the rotational axis direction of the screw driver can be made smaller.

<Third Embodiment>

A power tool according to a third embodiment of the present invention will be described while referring to FIGS. 8 and 9. The power tool of the present embodiment is applied to a screw driver.

Figure 8:
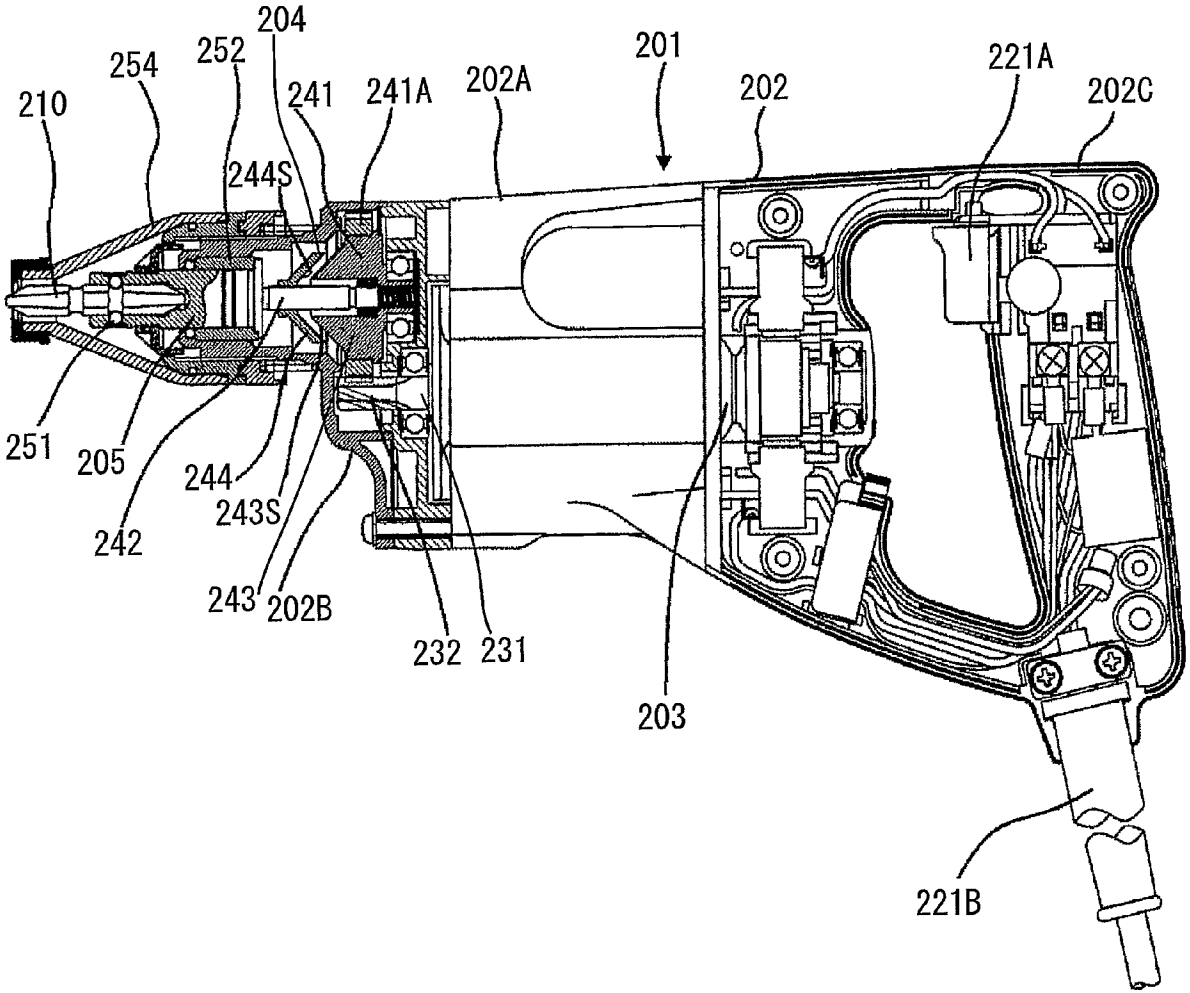
FIG. 8 is a cross-sectional view showing a screw driver embodying a power tool according to a third embodiment of the present invention.
Figure 9:
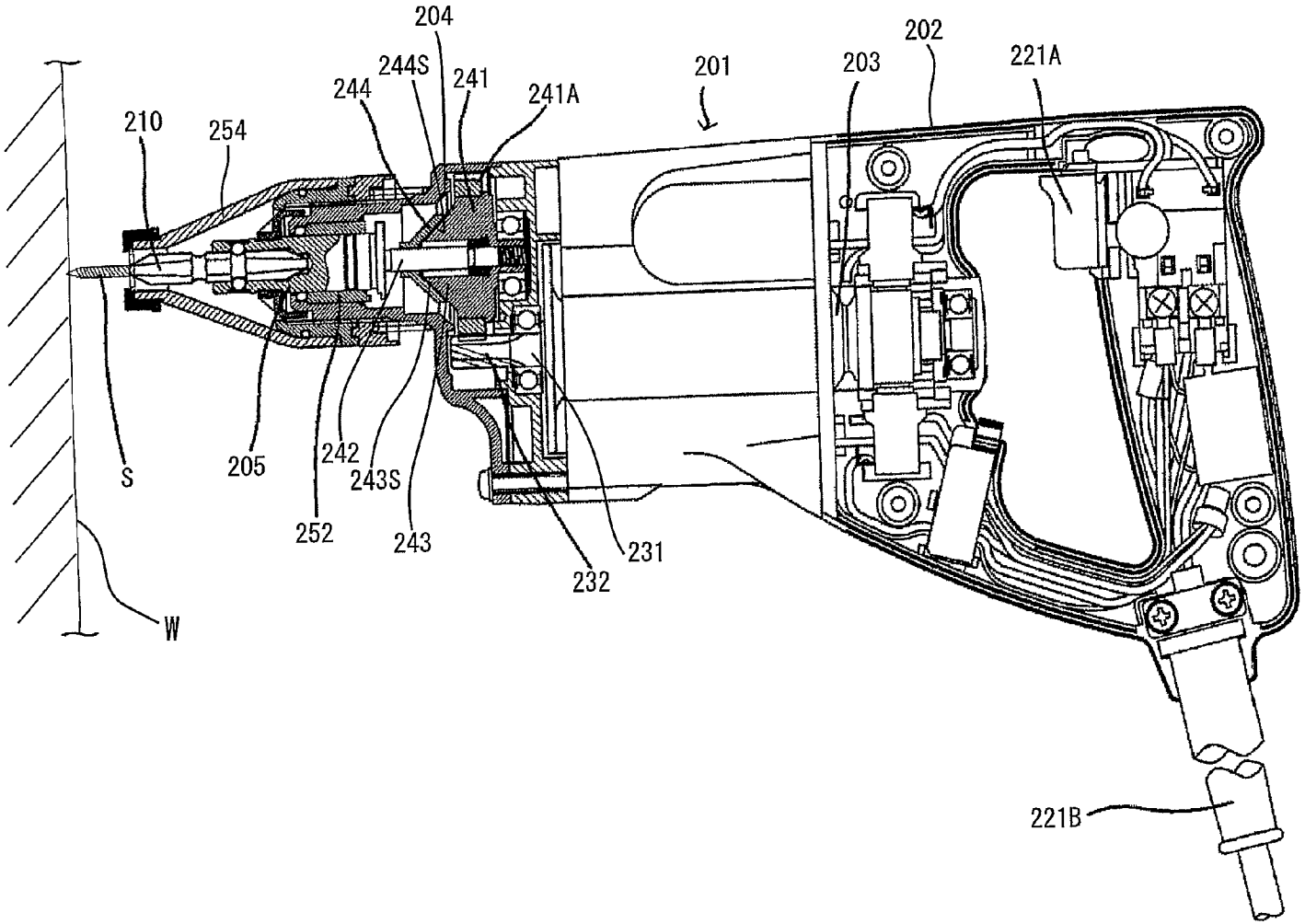
FIG. 9 is a cross-sectional view showing the screw driver according to the third embodiment during a screw driving operation.

FIG. 8 shows a screw driver 201 according to the third embodiment. The screw driver 201 includes a housing 202 serving as the outer shell and accommodating various components. The housing 202 includes a motor housing 202A accommodating a motor 203, a clutch housing 202B accommodating a clutch section 204, and a handle housing 202C having substantially D-shape and serving as a handle gripped by a user. The handle housing 202C is provided at the rear side of the motor housing 202A, and the clutch housing 2023 is provided at the front side of the motor housing 202A.

A trigger 221A is provided to the inner peripheral surface of the D-shape of the handle housing 202C. A power code 221B is provided at the lower side of the handle housing 202C.

The motor 203 is supported by the housing 2 (motor housing 202A). The motor 203 has an output shaft that extends forward from the main body of the motor 203 and that outputs rotational driving force. A pinion 232 is provided to the output shaft. The drive member 241 is rotatably provided within the clutch housing 202B. A gear 241A is fixed to the outer circumferential surface of the drive member 241 by press fit, so that the gear 241A meshingly engages the pinion 232. The drive member 241 is formed with a hollow space at its center. An end-bit mounting section 205 is rotatably supported by the clutch housing 202B via a metal bearing 252. A shaft 242 is integrally formed with the end-bit mounting section 205. The shaft 242 is inserted into the hollow space of the drive member 241. A follow member 244 is fixed to the shaft 242 by press fit. An end bit 210 is held by the end-bit mounting section 205 by balls 251.

The drive member 241 has a conical section 243 at its front part. The conical section 243 has a convex section 243S (drive-side contact surface) facing the front side and having a conical shape. The follow member 244 is a conical-shaped plate member having predetermined thickness. The follow member 244 has a concave section 244S (follow-side contact surface) facing the rear side and having a conical shape that fits the conical shape of the convex section 243S.

The operation of the screw driver 201 according to the third embodiment will be described while referring to FIG. 9.

When the user presses the trigger 221A in a state where the power code 221B is connected to the power and the end bit 210 is engaged with a screw S, the motor 203 is supplied with electricity and starts rotation. The pinion 232 also rotates and transmits the rotation to the drive member 241 because the pinion 232 meshingly engages the gear 241A of the drive member 241.

When the screw S is pressed against a wall W, the end bit 210 and the end-bit mounting section 205 move rearward relative to the housing 202. At the same time, the shaft 242 provided integrally with the end-bit mounting section 205 also moves rearward relative to the housing 202. The follow member 244 fixed to the shaft 242 also moves rearward relative to the housing 202.

In this way, the rearward movement of the follow member 244 causes the conical convex section 243S of the drive member 241 to contact and engage the conical concave section 244S of the follow member 244. This engagement transmits the rotation from the drive member 241 to the follow member 244. Here, the engagement between the drive member 241 and the follow member 244 is achieved by the conical convex section 243S and the conical concave section 244S. Thus, the surface area of engagement (contact) becomes larger, and the transmission by the frictional force can be performed more efficiently.

Note that, when driving of the screw S into the wall W is completed, a stopper 254 abuts on the wall W so that the rotational force is not transmitted to the screw S from the end bit 210.

In the above-described embodiment, the conical convex section 243S is provided to the drive member 241, and the conical concave section 244S is provided to the follow member 244. However, a conical concave section may be provided to a drive member, and a conical convex section may be provided to a follow member.

Further, in the above-described embodiment, the conical convex section 243S is provided to a single drive member 241, and the conical concave section 244S is provided to a single follow member 244. However, a plurality of conical convex sections may be provided to the respective ones of a plurality of drive members, and a plurality of conical concave sections may be provided to the respective ones of a plurality of follow members. Similarly, a plurality of conical concave sections may be provided to the respective ones of a plurality of drive members, and a plurality of conical convex sections may be provided to the respective ones of a plurality of follow members.

While the invention has been described in detail with reference to the above aspects thereof, it would be apparent to those skilled in the art that various changes and modifications may be made therein without departing from the scope of the claims.

For example, in the above-described embodiments, the power tool of the present invention is applied to a screw driver. However, the power tool of the present invention could be applied to other kinds of power tools that transmit the rotational driving force of a driving section to an end bit, such as a drill.

The invention claimed is:

1. A power tool comprising:

a handle configured to be gripped by a user;

a driving section configured to generate rotational driving force selectively in a forward direction and in a reverse direction and including an output shaft that outputs the rotational driving force;

an end-bit mounting section configured to hold an end bit and to be rotatable about a rotational axis extending in an axial direction; and a friction clutch provided between the end-bit mounting section and the driving section and serving as a first clutch movable between a transmission position and a cutoff position, the friction clutch comprising:

a drive member driven by the driving section and including a drive-side contact surface; and a follow member including a follow-side contact surface that is capable of contacting the drive-side contact surface and slidingly movable relative to the drive-side contact surface to generate a frictional force therebeween when the end-bit mounting section moves toward the driving section in the axial direction; and a second clutch provided between the end-bit mounting section and the driving section, wherein the user gripping the handle and pressing the end bit against a workpiece moves the end-bit mounting section toward the driving section in the axial direction and generates a torque transmitted to the end bit mounting section by the friction clutch, wherein the torque transmitted to the end bit mounting section by the frictional clutch is generated only by frictional force, wherein, when the first clutch is at the transmission position, the rotational driving force of the driving section at least in the forward direction can be transmitted to the end-bit mounting section, wherein, when the first clutch is at the cutoff position, the rotational driving force of the driving section through the first clutch is cut off before the end-bit mounting section, and wherein the second clutch is configured to transmit the rotational driving force of the driving section only in the reverse direction to the end-bit mounting section via a different route from the first clutch.

2. The power tool as claimed in claim 1, further comprising:

an accommodating section having an inner space and accommodating the drive member and the follow member in the inner space; and a seal member that isolates the inner space of the accommodating section from outside of the accommodating section.

3. The power tool as claimed in claim 1, wherein the first clutch is configured to transmit the rotational driving force of the driving section both in the forward direction and in the reverse direction to the end-bit mounting section when the first clutch is at the transmission position.

4. The power tool as claimed in claim 1, wherein the first clutch comprises a multiple-plate friction clutch.

5. The power tool as claimed in claim 4, wherein the multiple-plate friction clutch comprises:

a plurality of drive members that rotates together with the driving section, each of the plurality of drive members having a plate shape; and a plurality of follow members that rotates together with the end-bit mounting section, each of the plurality of follow members having a plate shape; and wherein the plurality of drive members and the plurality of follow members are arranged alternately from the end-bit mounting section side toward the driving section side, one of the plurality of follow members being the closest to the end-bit mounting section.

6. The power tool as claimed in claim 4, further comprising:

a gear reduction mechanism rotatably driven by the output shaft; and a shaft connected to the end-bit mounting section and configured to rotate coaxially with the end bit, wherein the multiple-plate friction clutch is arranged between the gear reduction mechanism and the shaft.

7. The power tool as claimed in claim 6, wherein the end-bit mounting section is fitted to the shaft.

8. The power tool as claimed in claim 4, wherein the rotational driving force of the driving section in the forward direction is transmitted to the end-bit mounting section only via the multiple-plate friction clutch; and wherein transmission efficiency of the rotational driving force in the forward direction changes in response to movement of the multiple-plate friction clutch in the axial direction.

9. The power tool as claimed in claim 4, wherein the multiple-plate friction clutch is arranged coaxially with the rotational axis of the end-bit mounting section.

10. The power tool as claimed in claim 4, further comprising a plurality of springs arranged adjacent to the multiple-plate friction clutch at either one of the end bit side and the driving section side or at both of the end bit side and the driving section side, the plurality of springs being configured to urge the multiple-plate friction clutch toward at least one of the end bit side and the driving section side, wherein at least one of the plurality of springs is prevented from being compressed by an amount greater than a predetermined amount, allowing the plurality of springs to have a combined spring constant that changes at the predetermined amount.

11. The power tool as claimed in claim 10, wherein the plurality of springs is arranged in series adjacent to the multiple-plate friction clutch at either one of the end bit side and the driving section side or at both of the end bit side and the driving section side.

12. The power tool as claimed in claim 1, wherein the friction clutch comprises a multiple-plate friction clutch configured to be movable in the axial direction; and wherein the multiple-plate friction clutch is configured to move in the axial direction to transmit the rotational driving force of the output shaft to the end bit in a state where the end bit is pressed against a workpiece.

13. The power tool as claimed in claim 12, wherein the multiple-plate friction clutch comprises:

a plurality of drive members that rotates together with the driving section, each of the plurality of drive members having a plate shape; and a plurality of follow members that rotates together with the end-bit mounting section, each of the plurality of follow members having a plate shape; and wherein the plurality of drive members and the plurality of follow members are arranged alternately from the end-bit mounting section side toward the driving section side, one of the plurality of follow members being the closest to the end-bit mounting section.

14. The power tool as claimed in claim 12, further comprising:

a gear reduction mechanism rotatably driven by the output shaft; and a shaft connected to the end-bit mounting section and configured to rotate coaxially with the end bit, wherein the multiple-plate friction clutch is arranged between the gear reduction mechanism and the shaft.

15. The power tool as claimed in claim 14, wherein the end-bit mounting section is fitted to the shaft.

16. The power tool as claimed in claim 12, wherein the driving section is configured to generate the rotational driving force selectively in a forward direction and in a reverse direction;

wherein the rotational driving force of the driving section in the forward direction is transmitted to the end-bit mounting section only via the multiple-plate friction clutch; and wherein transmission efficiency of the rotational driving force in the forward direction changes in response to movement of the multiple-plate friction clutch in the axial direction.

17. The power tool as claimed in claim 12, wherein the multiple-plate friction clutch is arranged coaxially with the rotational axis of the end-bit mounting section.

18. The power tool as claimed in claim 12, further comprising a plurality of springs arranged adjacent to the multiple-plate friction clutch at either one of the end bit side and the driving section side or at both of the end bit side and the driving section side, the plurality of springs being configured to urge the multiple-plate friction clutch toward at least one of the end bit side and the driving section side, wherein at least one of the plurality of springs is prevented from being compressed by an amount greater than a predetermined amount, allowing the plurality of springs to have a combined spring constant that changes at the predetermined amount.

19. The power tool as claimed in claim 18, wherein the plurality of springs is arranged in series adjacent to the multiple-plate friction clutch at either one of the end bit side and the driving section side or at both of the end bit side and the driving section side.

20. The power tool as claimed in claim 18, wherein the plurality of springs is arranged in parallel adjacent to the multiple-plate friction clutch at either one of the end bit side and the driving section side.

21. The power tool as claimed in claim 1, wherein the end-bit mounting section is configured to be movable in the axial direction between a first position and a second position;

wherein the drive member has a first engaging section serving as the drive-side contact surface;

wherein the follow member has a second engaging section capable of engaging the first engaging section and serving as the follow-side contact surface;

wherein the first engaging section and the second engaging section are configured to be in non-engagement with each other when the end-bit mounting section is at the first position and to be in engagement with each other when the end-bit mounting section is at the second position; and wherein one of the first engaging section and the second engaging section has a conical convex section, and another one of the first engaging section and the second engaging section has a conical concave section.

22. A power tool comprising:

a handle configured to be gripped by a user;

a driving section configured to generate rotational driving force selectively in a forward direction and in a reverse direction, the driving section including an output shaft that outputs the rotational driving force;

an end-bit mounting section configured to hold an end bit and to be rotatable about a rotational axis; and a first clutch and a second clutch both provided between the end-bit mounting section and the driving section, the first clutch being a friction clutch and being movable between a transmission position where the rotational driving force of the driving section at least in the forward direction can be transmitted to the end-bit mounting section, and a cutoff position where the rotational driving force of the driving section through the first clutch is cut off before the end-bit mounting section, the second clutch being configured to transmit the rotational driving force of the driving section only in the reverse direction to the end-bit mounting section via a different route from the first clutch, wherein the user gripping the handle and pressing the end bit against a workpiece moves the first clutch to the transmission position and generates a torque transmitted to the end-bit mounting section to rotate the end bit, and wherein the torque transmitted to the end-bit mounting section by the first clutch is generated only by frictional force.

23. The power tool as claimed in claim 22, wherein:

the end-bit mounting section is configured to be rotatable about the rotational axis extending in an axial direction, the end-bit mounting section being movable in the axial direction in accordance with the user pressing of the end bit against a workpiece;

the first clutch is a multiple-plate friction clutch, and the user gripping the handle and pressing the end bit against a workpiece moves the end-bit mounting section toward the driving section in the axial direction and generates the torque transmitted to the end-bit mounting section by the multiple-plate friction clutch.

24. The power tool as claimed in claim 22, wherein:

the end-bit mounting section is configured to be rotatable about the rotational axis extending in an axial direction, the end-bit mounting section being configured to be movable in the axial direction between a first position and a second position; and the first clutch includes:

a drive member that receives the rotational driving force of the driving section and that is rotatable by the rotational driving force, the drive member including a first engaging section; and a follow member including a second engaging section capable of engaging the first engaging section, the follow member being rotatable, the first engaging section and the second engaging section is configured to be in non-engagement with each other when the end-bit mounting section is at the first position and to be in engagement with each other when the end-bit mounting section is at the second position, one of the first engaging section and the second engaging section has a conical convex section, and another one of the first engaging section and the second engaging section has a conical concave section, the conical convex section and the conical concave section being slidingly movable relative to each other to generate a frictional force therebetween when the end-bit mounting section is at the second position, and the driving force of the driving section is transmitted to the end-bit mounting section by the frictional force generated between the conical convex section and the conical concave section.

25. The power tool as claimed in claim 22, wherein:

the end-bit mounting section is configured to hold an end bit and to be movable in an axial direction in accordance with the user pressing of the end bit against a workpiece in the axial direction, the first clutch further comprises:

a drive member driven by the driving section; and a follow member provided between the end-bit mounting section and the driving section, the follow member capable of contacting the drive member and slidingly movable relative to the drive member when the end-bit mounting section moves toward the driving section in the axial direction, the user gripping the handle and pressing the end bit against a workpiece moves the end-bit mounting section toward the driving section in the axial direction and generates the torque transmitted to the end-bit mounting section by increase of a frictional force generated between the drive member and the follow member, and the torque transmitted to the end-bit mounting section is generated only by frictional force between the drive member and the follower member.

26. The power tool as claimed in claim 22, wherein:

the end-bit mounting section is configured to be rotatable about the rotational axis extending in an axial direction and configured to move in the axial direction, and the first clutch further comprises:

a drive member driven by the driving section; and a follow member movable in the axial direction relative to the end-bit mounting section and the drive member and configured to transmit the rotational driving force from the drive member to the end-bit mounting section, the movement of the end-bit mounting section toward the driving section in the axial direction moving the follow member toward the drive member to transmit the rotational driving force from the drive member to the end-bit mounting section.

27. The power tool as claimed in claim 26, wherein the movement of the end-bit mounting section toward the driving section in the axial direction causes the follow member to be sandwiched between the drive member and the end-bit mounting section.

28. The power tool as claimed in claim 27, wherein the sandwich of the follow member between the drive member and the end-bit mounting section generates a frictional force between the drive member and the follow member, the fictional force serving as a torque to transmit the rotational driving force of the drive member to the end-bit mounting section.

29. The power tool as claimed in claim 22, wherein:

the end-bit mounting section is configured to be rotatable about the rotational axis extending in an axial direction and is configured to move in the axial direction, and the first clutch comprises:

a drive member driven by the driving section; and a follow member disposed between the drive member and the end-bit mounting section in the axial direction, the movement of the end-bit mounting section toward the driving section in the axial direction moving the follow member toward the drive member and causing the follow member to be sandwiched between the drive member and the end-bit mounting section.

30. The power tool as claimed in claim 29, wherein the sandwich of the follow member between the drive member and the end-bit mounting section generates a frictional force between the drive member and the follow member, the fictional force serving as a torque to transmit the rotational driving force of the drive member to the end-bit mounting section.

* * * * *